US007036252B2

(12) United States Patent
Haroldsen et al.

(10) Patent No.: US 7,036,252 B2
(45) Date of Patent: May 2, 2006

(54) ACTUATING COUPLER FOR HEAVY MACHINERY PERIPHERAL ATTACHMENTS

(75) Inventors: J. Tron Haroldsen, Herriman, UT (US); Jeremy K. Nix, Provo, UT (US)

(73) Assignee: Asphalt Zipper, Pleasant Grove, UT (US)

( * ) Notice: Subject to any disclaimer, the term of this patent is extended or adjusted under 35 U.S.C. 154(b) by 26 days.

(21) Appl. No.: 10/337,584

(22) Filed: Jan. 7, 2003

(65) Prior Publication Data

US 2004/0128870 A1 Jul. 8, 2004

(51) Int. Cl.
*E02F 3/96* (2006.01)

(52) U.S. Cl. ..... 37/468; 37/309; 37/903; 299/39.4

(58) Field of Classification Search ..... 37/403, 37/409, 410, 468, 903; 299/39.2, 39.4; 404/128, 404/86

See application file for complete search history.

(56) References Cited

U.S. PATENT DOCUMENTS

| | | | | | |
|---|---|---|---|---|---|
| 3,136,078 | A | * | 6/1964 | Renault | 172/547 |
| 3,864,793 | A | * | 2/1975 | Guest | 24/569 |
| 3,989,404 | A | * | 11/1976 | Burton | 404/128 |
| 4,189,854 | A | * | 2/1980 | Haynes | 37/404 |
| 4,364,434 | A | * | 12/1982 | Erholm | 171/63 |
| 4,597,205 | A | * | 7/1986 | Guest | 37/241 |
| 4,878,713 | A | * | 11/1989 | Zanetis | 299/39.5 |
| 5,378,081 | A | * | 1/1995 | Swisher, Jr. | 299/39.5 |
| 5,477,627 | A | * | 12/1995 | Nolin et al. | 37/3 |
| 6,088,939 | A | * | 7/2000 | Logan | 37/468 |
| 6,116,699 | A | * | 9/2000 | Kaczmarski et al. | 299/39.5 |

* cited by examiner

*Primary Examiner*—Thomas A Beach
(74) *Attorney, Agent, or Firm*—Michael F. Krieger; Kirton & McConkie

(57) ABSTRACT

A locking device to hold an asphalt milling machine on a loader bucket to increase stability and accuracy of the milling machine and increase the speed at which the loader bucket can transition between directing the milling machine and picking up ground asphalt.

10 Claims, 7 Drawing Sheets

ACTUATING COUPLER FOR HEAVY MACHINERY PERIPHERAL ATTACHMENTS

BACKGROUND

1. Field of the Invention

The present invention relates to peripheral attachments, and more particularly, to various mechanisms, systems, and methods for quickly and efficiently removably coupling peripheral attachments to heavy machinery by way of an actuating coupler.

2. Background of the Invention and Related Art

In the general and heavy construction industries, and particularly the earth-moving and paving industries, it is common practice to utilize peripheral attachments that temporarily and removably couple to various machinery, such as front-end loaders, skid steers, backhoes, etc., to assist construction workers in the labor-intensive task of removing existing surface or paving materials, such as asphalt, concrete, and other similar materials (hereinafter referred to collectively as paving or paving materials) for one or more purposes. For example, peripheral attachments may be utilized to cut and remove old sections of paving, in order to resurface an area or prepare the area to receive new paving, to access utility and power lines, and/or to perform a variety of other similar tasks. Several different types of peripheral attachments have been developed to assist construction workers in these labor-intensive tasks.

SUMMARY AND OBJECTS OF THE INVENTION

In light of the deficiencies found in prior art coupling means, the present invention seeks to provide a more efficient and effective method of coupling safety.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other advantages and features of the invention are obtained, a more particular description of the invention briefly described above will be rendered by reference to specific embodiments thereof, which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

It will be readily understood that the components of the present invention, as generally described and illustrated in the figures herein, could be arranged and designed in a wide variety of different configurations. Thus, the following more detailed description of the embodiments of the system and method of the present invention, and represented in FIGS. 1 through 8, is not intended to limit the scope of the invention, as claimed, but is merely representative of the presently preferred embodiments of the invention.

The presently preferred embodiments of the invention will be best understood by reference to the drawings wherein like parts are designated by like numerals throughout.

The present invention relates to peripheral attachments, and more particularly to an attachment system for engaging a milling machine to a bucket of a tractor, loader, backhoe or other equipment capable of attaching a bucket.

In the disclosure and in the claims the term "paving material" shall refer to any material that may be used to pave a road, path, sidewalk, parking lot, driveway, thoroughfare, or any other similar surface. Examples of paving materials include asphalt, tarmac, pavement, cement, clay, stone and dirt.

Embodiments of the present invention may be used to mill, grind, cut, and/or slot paving material that may be configured to be coupled to a piece of heavy machinery 30 (e.g., a front-end loader, skid steer, backhoe, excavator, or other similar piece of machinery) that selectively pushes or pulls the peripheral attachment in a desired direction. The peripheral attachment includes a cutting head that spins on an axis to either break up and mill or cut the paving material.

FIGS. 1–7 illustrate embodiments of a rotary milling machine 34 having a bucket slot 20 into which the bottom of a rotor bucket may be placed.

Figure 1B:
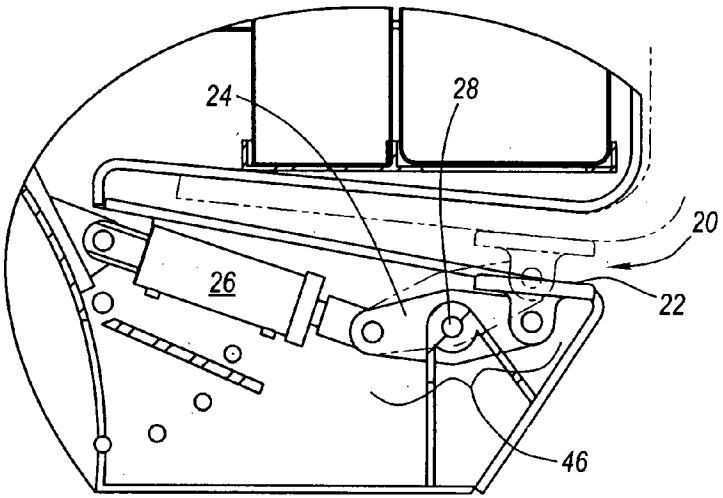
FIGS. 1A–1C and 2 illustrate an asphalt milling machine having a bucket engagement area, embodiments of the hydraulic actuating mechanism and a bucket locking plate.
Figure 1C:
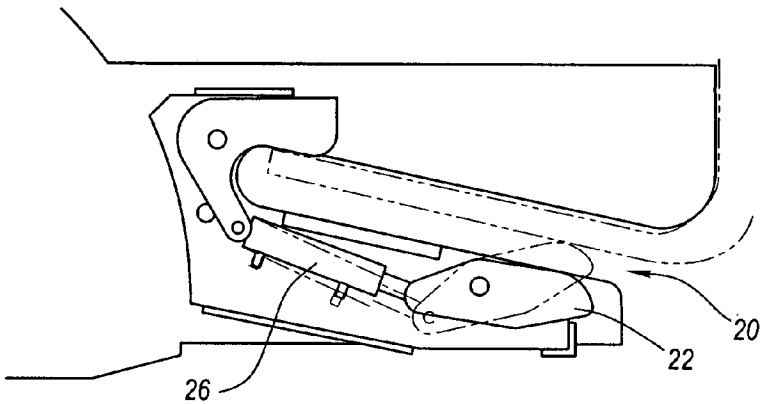
Figure 1A:
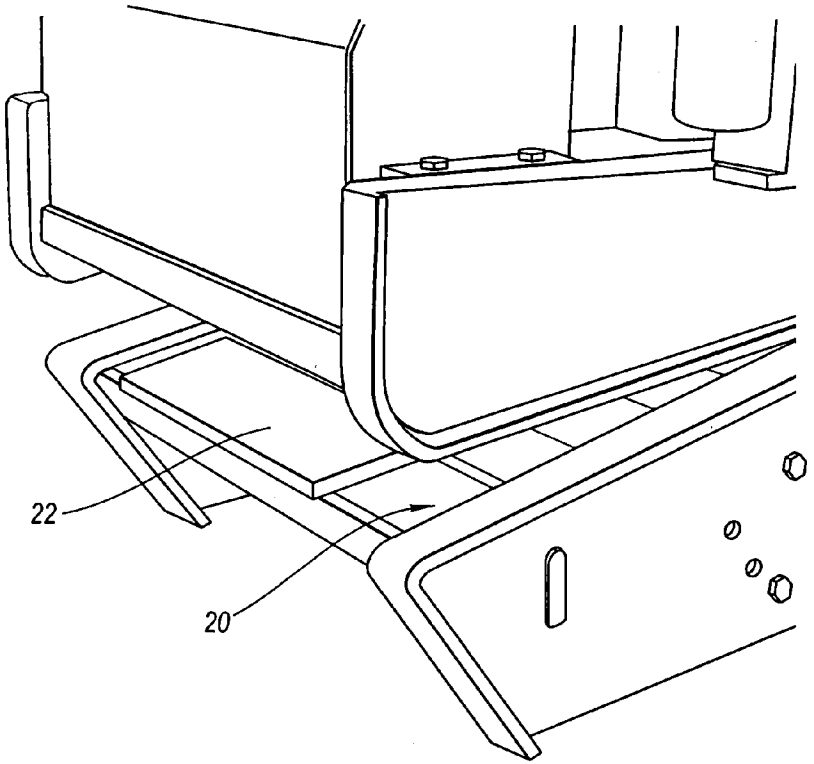
Figure 3:
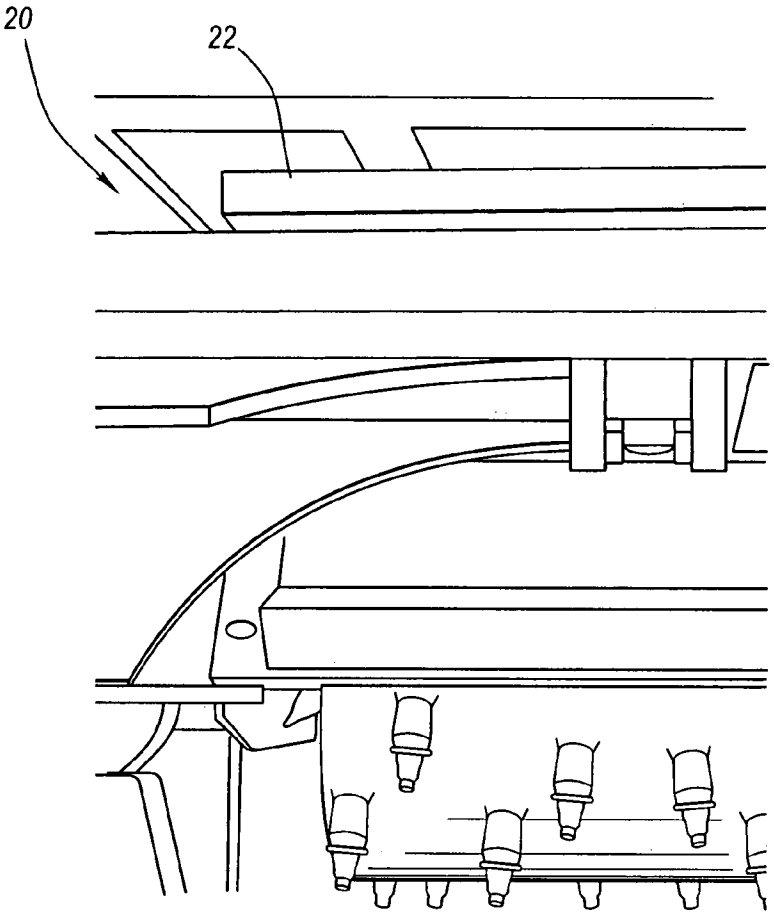
FIG. 3 illustrates the cylindrical mandrel of a milling machine, a locking plate and a bucket engagement area.
Figure 2:
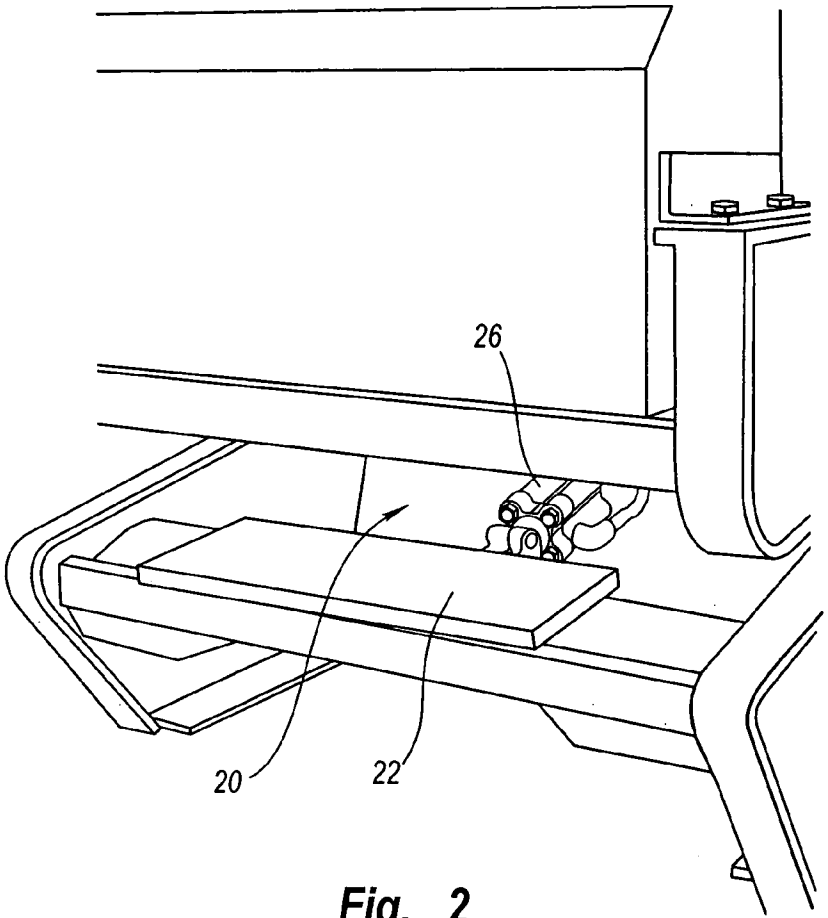

FIG. 2 illustrates the slot 20 and more particularly shows locking plate 22 resting against the bottom of slot 20. This is the position in which locking plate 22 will be prior to insertion of the bucket. Attached to the bottom of locking plate 22 is a trigger system 46, comprising transfer arm 24, which transfers motion from a hydraulic ram 26 from a linear motion into an arced generally vertical motion. In other words, as hydraulic ram 26 is extended, pressure is placed on transfer arm 24 which then converts that linear extension into an upward movement of locking plate 22. As locking plate 22 is moved upward, it pushes the bottom of the loader bucket against the top of slot 20.

Figure 5:
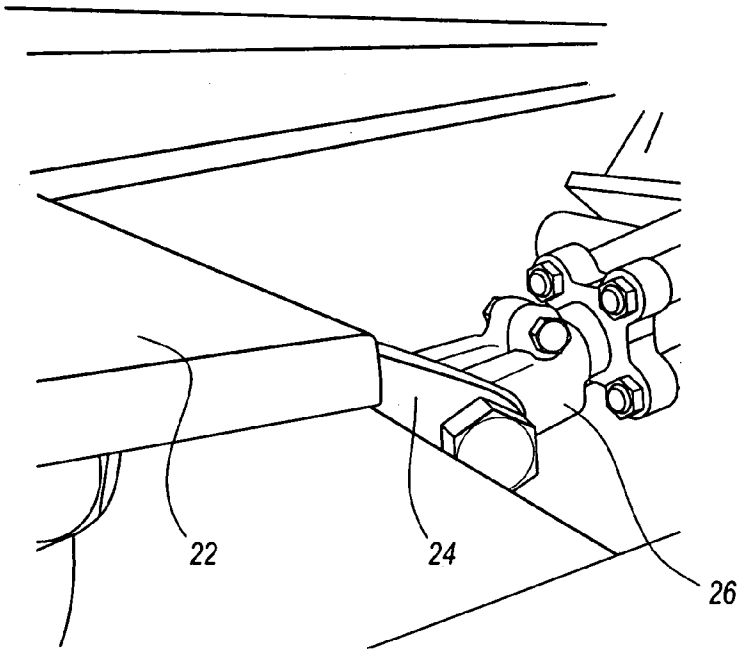
FIGS. 5 and 6 illustrate the hydraulic actuating mechanism for the locking plate.
Figure 4:
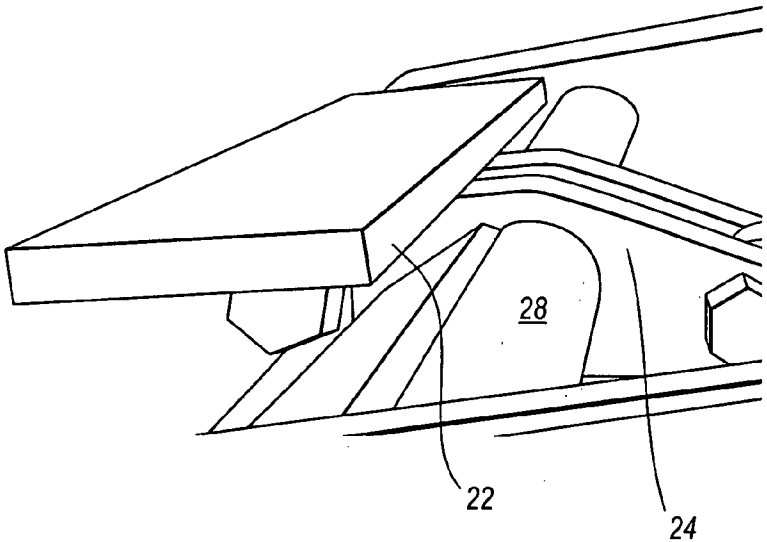
FIG. 4 illustrates the locking plate, the pivot point and actuating mechanism.
Figure 6:
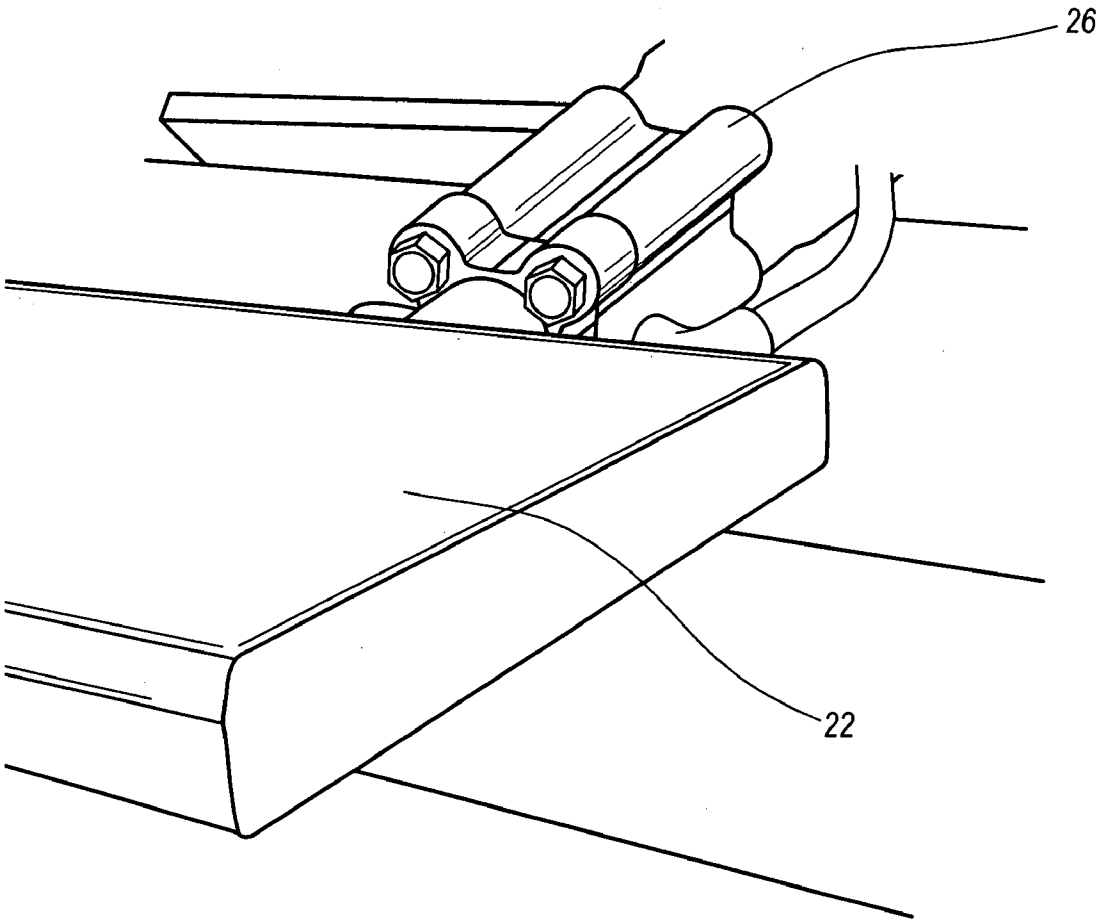
Figure 7A:
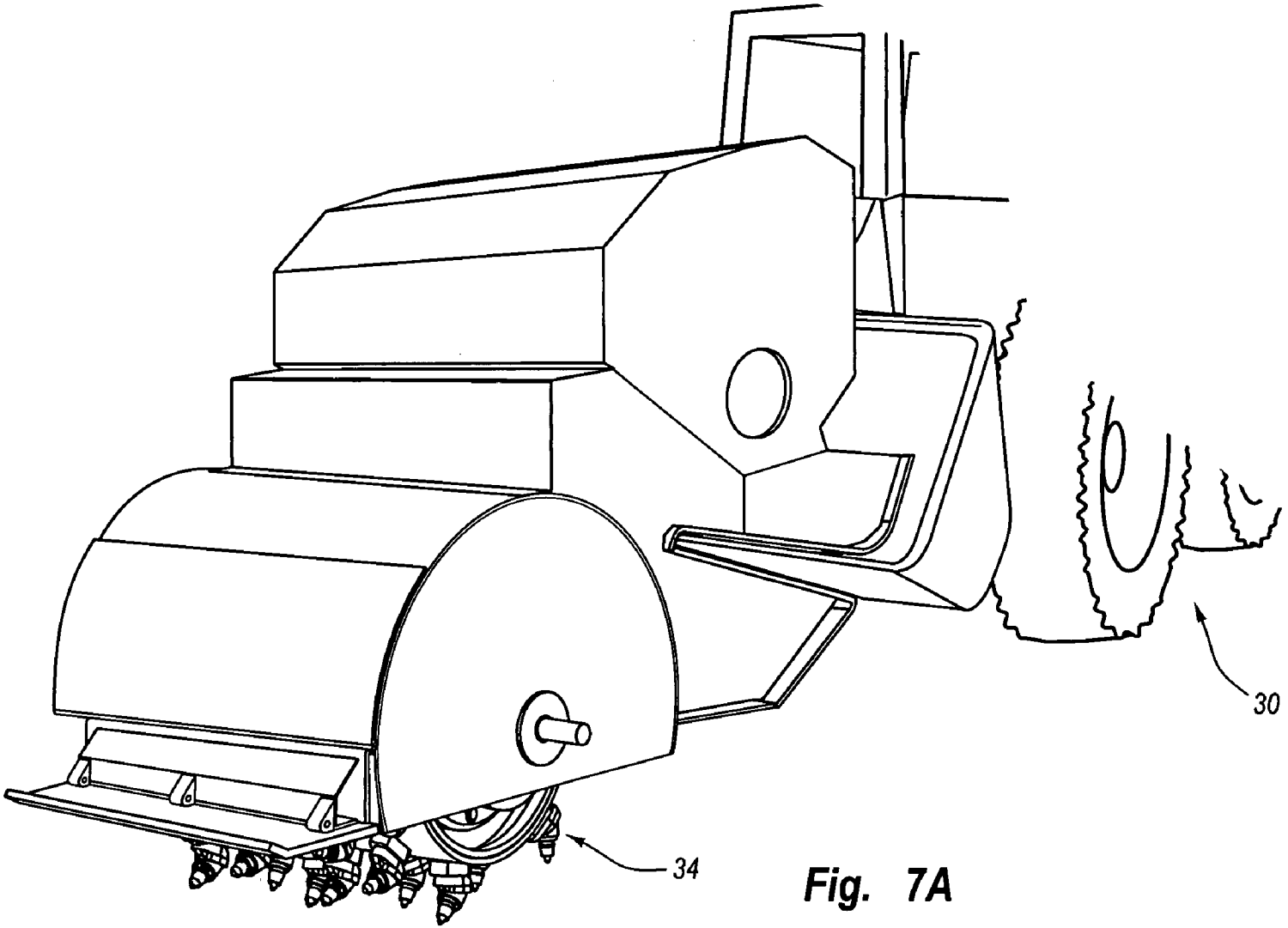
FIGS. 7A–7C illustrates an asphalt milling machine in relation to the bucket of excavation equipment.
Figure 7C:
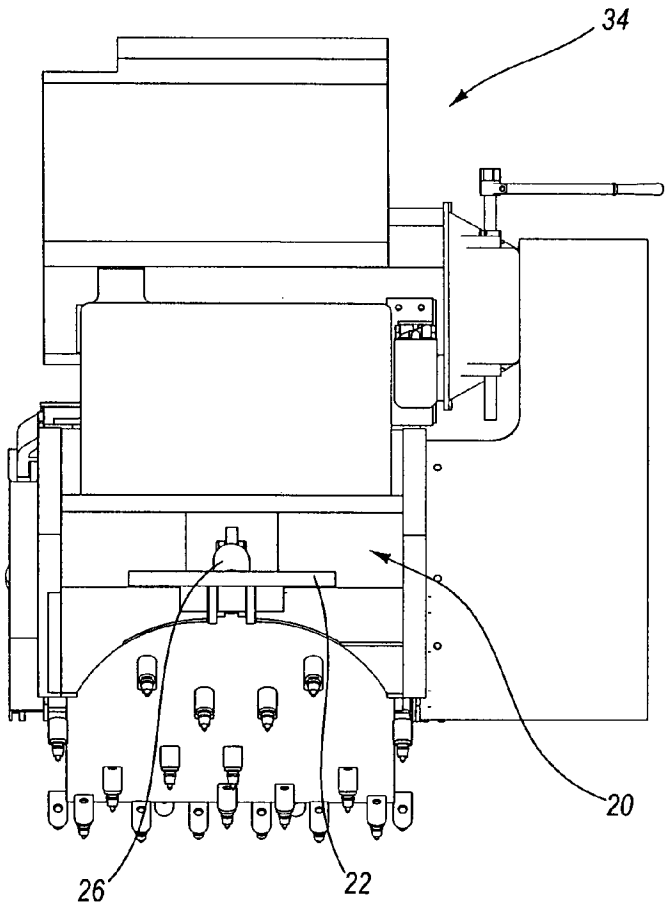
Figure 7B:
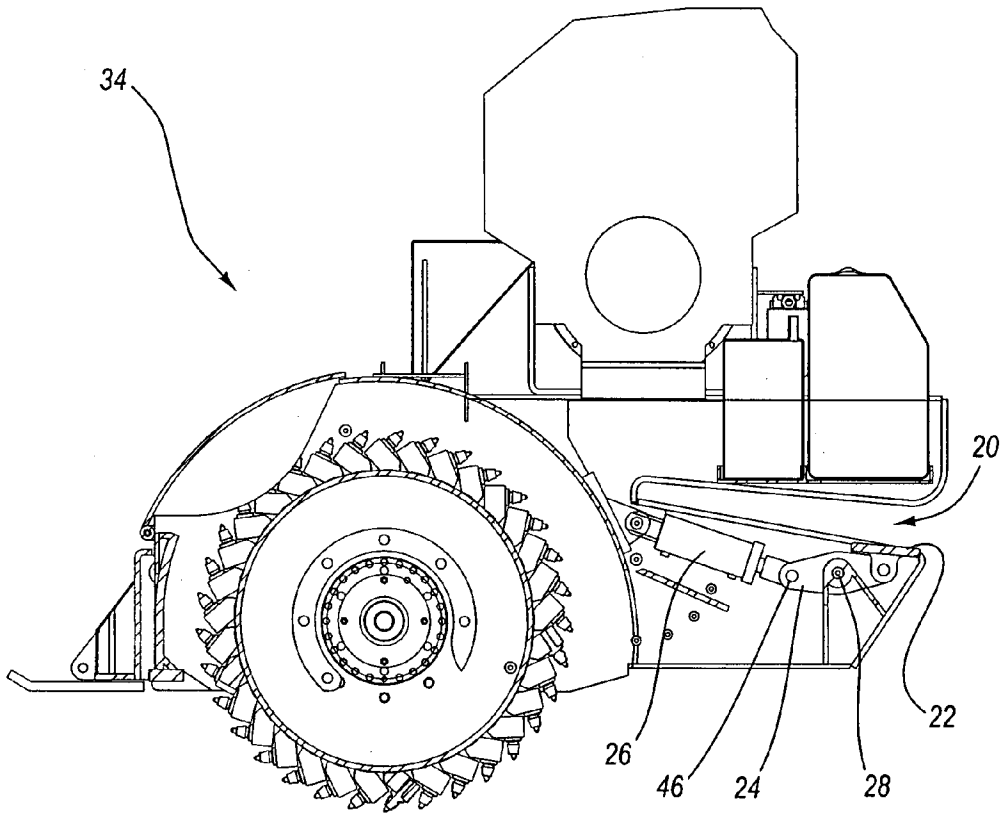
Figure 8:
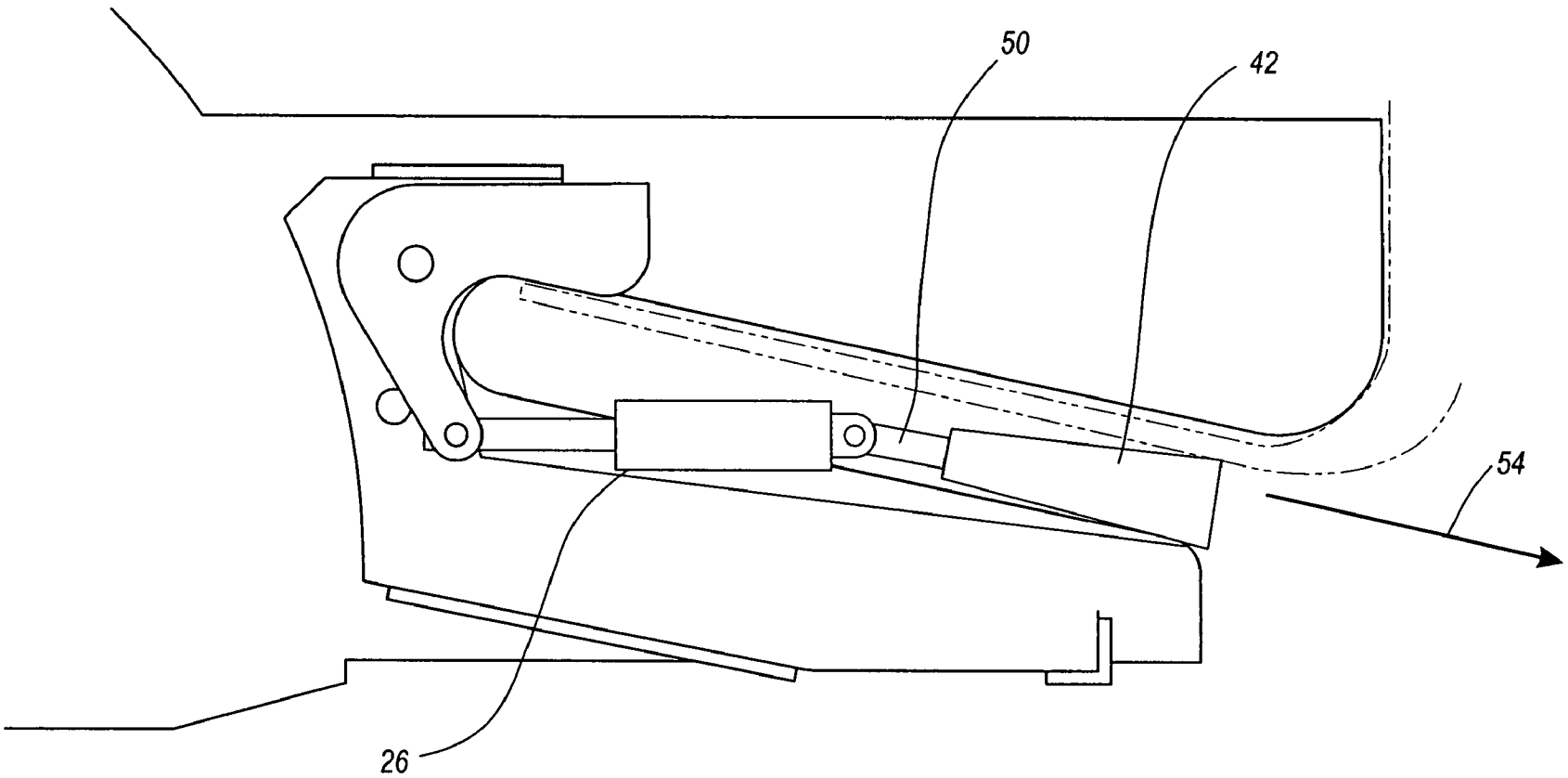
FIG. 8 illustrates a wedged shaped locking plate and the linear motion of the locking plate.

The movement of transfer arm 24 can be more clearly seen in FIGS. 4, 5, and 6. FIGS. 4, 5, and 6 depict the inside of slot 20 and in particular FIG. 4 shows transfer arm 24 attached to the bottom of locking plate 22. FIG. 5 shows the attachment of hydraulic ram 26 to the back of transfer arm 24. FIGS. 4 and 6 both show locking plate 22 in a partially elevated position. Hydraulic ram 26 can be clearly seen in FIG. 6. It is important to note that hydraulic ram 26 is not located in a plane parallel with the locking plate so that extension of ram 26 results in a downward motion being exerted on transfer arm 24 which then pivots about a point 28 to translate movement into a vertical vector on locking plate 22. When hydraulic ram 26 is completely extended, locking plate 22 will be pressed against the top of slot 20. If a loader bucket is placed in slot 20 when the hydraulic ram 26 is actuated, this upward pressure will result in the bucket being locked in place inside of slot 20.

There are several advantages of having a loader bucket locked in slot 22. The first advantage is that when compared to milling machines being directed and moved when attached to a bucket, the locking plate provides a significant improvement in the stability of the milling machine during transport and operation. For example, when a bucket is located into a slot without a locking plate, the bucket will initially apply pressure to the bottom of the slot as the milling machine is lifted. As the milling machine begins to operate and the bucket is used to press the milling machine down into the asphalt surface, the orientation of the bucket within the slot will change and the bucket will begin to press against the top of the slot. Because the slot typically has several inches between the top and bottom, the bucket may travel through this arc without having any positive engagement to the milling machine. As a result, as the milling machine begins to encounter asphalt and vibrates as the rotary mill begins to penetrate the asphalt, this vibration and "bucking" results in movement between the relative position of the bucket and the milling machine. This movement makes it difficult to accurately place the milling machine into the asphalt since the bucket is wider then the milling machine the milling machine tends to wander to the left or to the right within the bucket. While this is not a problem when a wide portion of asphalt is to be pulverized, this is a problem if a narrow strip of asphalt is the intended target of the milling machine. Because the milling machine wanders back and forth in the bucket, it is difficult to accurately place the milling machine within the desired area of asphalt.

In contradistinction, when the milling machine is locked onto the bucket using the device of the present invention, the machine does not wander on the bucket and is easily placed into the portion of asphalt to be pulverized. A subsidiary benefit of this placement is that the machine need not be locked to the center of the bucket but if desired, may be locked to one of the edges of the bucket. This is particularly desirable in tight locations when the asphalt to be pulverized is next to a building or curb or obstacle.

In addition to the enhanced stability and accuracy provided by the present invention, another advantage is the speed in changing between the loader bucket for guiding the milling machine and using the bucket to pick up and load onto a truck the pulverized asphalt. This advantage is particularly clear when a comparison is made to the quick released system typically in place today. In a quick release system, two horizontal bars with hooks are used so that a loader may engage a bucket, or may leave the bucket at the side of the road and engage the quick release device of the milling machine. When the milling operation is finished, the milling machine is then placed to the side, the loader returns to the location of the bucket, engages the bucket and then returns to the site to load the pulverized asphalt.

In contrast, when using the present invention, the bucket always remains attached to the loader. As a result, there is no need to return to the site of the bucket to attach the bucket after the milling operation is completed. Instead, the milling machine may be placed to the side and the bucket can immediately be used to load the pulverized asphalt. This results in a significant savings of time and also prevents the introduction of extra equipment into sometimes tightly confined areas. Because the bucket need not be left behind, other equipment may be placed in the location where that bucket would have typically been placed. In addition, many devices do not have quick connect or quick release attachments and cannot be used with these systems. Loaders without quick release systems still have a bucket, nevertheless, which allows use with the present invention.

Although a flat locking plate 22 is shown in the illustrations, it will be appreciated that any shaped locking plate may be employed which results in a pressure being applied to the bucket to retain the bucket in place relative to the position of the equipment being directed by the bucket.

In addition, other articulating arm shapes may be utilized to translate the movement of a hydraulic ram into a vertical component. For example in some embodiments, a shorter hydraulic ram could be placed directly under the locking plate to directly actuate the locking plate without the need for an articulating arm. In some embodiments, several articulating arms may be utilized having a hydraulic ram attached to each. In some embodiments, several actuating arms might be utilized both attached to one hydraulic ram. In some embodiments other motives and forces may be used to force locking plate against the bottom of the loader bucket. For example, pneumatic systems, electric systems, or other gear driven mechanic systems could be utilized to apply pressure to the loader bucket.

In addition to the single or multi-armed engagement devices described above, one embodiment of the present invention anticipates a wedge-shaped locking plate 42 that is directly connected to a hydraulic ram 26 without any intermediate curved transfer arm 24. Instead, the wedge 42 travels in a linear path 54 toward or away from the ram. In embodiments where the ram 26 is located inside the narrow end of the milling machine slot, the ram 26 is connected to the ram 26 either directly or with a straight transfer arm 50 interposed between the ram 26 and plate 42. After the loader bucket is placed in the slot 20, the ram 26 is activated pulling the wedge 42 into the narrow end of the slot 20 and wedging the bucket inside of the slot 20.

Similarly, when the ram 26 is located at the wide, open end of the slot 20, the ram 26 pushes the wedge 42 toward the closed end of the slot 20 to wedge the bottom of the bucket in the slot 20.

The present invention may be embodied in other specific forms without departing from its spirit of essential characteristics. The described embodiments are to be considered in all respects only al illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. A device for retaining in a fixed position an asphalt milling machine on a loader bucket, having a top, bottom, and sides, said device comprising:

a) a locking plate inside of a slot having a top and a bottom in a milling machine;

b) a transfer arm attached at one end to the locking plate; and c) a motive source attached to one end of the transfer arm to urge the transfer arm into motion, thereby causing the locking plate to engage a loader bucket inserted into the slot in the milling machine, thereby pushing the bottom of the loader bucket against the top of the slot, wherein the upward pressure results in the bucket being locked in place inside the slot.

2. A device as recited in claim 1, wherein the motive source is a pneumatic ram.

3. A device as recited in claim 1, wherein the motive source is a hydraulic ram.

4. A device as recited in claim 1, wherein the motive source is an electric motor.

5. A device as recited in claim 1, wherein the locking plate is shaped to conform with a loader bucket.

6. A device as recited in claim 1, wherein the locking plate is a wedge.

7. A device as recited in claim 1, wherein the locking plate has two transfer arms pivotally attached.

8. A device as recited in claim 1, wherein the transfer arm is curved.

9. A device as recited in claim 1, wherein the transfer arm is straight and is attached to a wedge-shaped locking plate.

10. A device as recited in claim 9, wherein the wedge-shaped transfer plate travels in a linear path to wedge a bottom of a loader bucket into the slot to retain the milling machine on the loader bucket.

* * * * *